US012070665B2

(12) United States Patent
Sanchez et al.

(10) Patent No.: US 12,070,665 B2
(45) **Date of Patent: *Aug. 27, 2024**

(54) GOLF CLUB HEAD HAVING MULTI-LAYERED STRIKING FACE

(71) Applicant: Acushnet Company, Fairhaven, MA (US)

(72) Inventors: Richard Sanchez, Temecula, CA (US); Richard L. Cleghorn, Oceanside, CA (US); Tony Luna, Vista, CA (US); Kyle A. Carr, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 74 days.

This patent is subject to a terminal disclaimer.

(21) Appl. No.: 17/902,266

(22) Filed: Sep. 2, 2022

(65) Prior Publication Data

US 2023/0201677 A1 Jun. 29, 2023

Related U.S. Application Data

(63) Continuation of application No. 17/563,521, filed on Dec. 28, 2021, now Pat. No. 11,491,377.

(51) Int. Cl.
*A63B 53/04* (2015.01)

(52) U.S. Cl.
CPC ..... *A63B 53/0475* (2013.01); *A63B 53/0408* (2020.08); *A63B 53/0416* (2020.08); *A63B 2209/00* (2013.01)

(58) Field of Classification Search
CPC ..... A63B 53/0475; A63B 53/0416; A63B 53/0408; A63B 2209/00; A63B 53/042; A63B 53/0425; A63B 53/0429; A63B 53/047
USPC ..... 473/329, 332, 342, 350
See application file for complete search history.

(56) References Cited

U.S. PATENT DOCUMENTS

| | | | | |
|---|---|---|---|---|
| 700,946 | A | 5/1902 | Kempshall | |
| 819,900 | A | 5/1906 | Martin | |
| 4,229,550 | A | 10/1980 | Jones | |
| 4,448,941 | A | 5/1984 | Cheung et al. | |
| 4,681,322 | A | 7/1987 | Straza et al. | |
| 5,058,895 | A | 10/1991 | Igarashi | |
| 5,083,778 | A * | 1/1992 | Douglass ..... | A63B 53/0487 473/329 |
| 5,106,094 | A | 4/1992 | Desbiolles et al. | |

(Continued)

FOREIGN PATENT DOCUMENTS

JP H05-7261 2/1993

OTHER PUBLICATIONS

The Royal and Ancient Golf Club of St. Andrews and USGA, Technical Description of the Pendulum Test, Revised Version, Nov. 2003.

(Continued)

*Primary Examiner* — Sebastiano Passaniti

(57) ABSTRACT

A golf club head having a multi-layered striking face is disclosed herein. More specifically, the golf club head in accordance with the present invention has an external frontal face layer, an internal rear face layer, and an intermediary sandwiched face layer juxtaposed between the external frontal face layer and the internal rear face layer. The intermediary sandwiched face layer may generally be made out of a high flexural modulus polymeric material.

10 Claims, 4 Drawing Sheets

(56) References Cited

U.S. PATENT DOCUMENTS 5,132,178 A 7/1992 Chyung et al.
5,163,682 A 11/1992 Schmidt et al.
5,238,529 A 8/1993 Douglas
5,299,807 A * 4/1994 Hutin ..... A63B 53/04 473/329
5,303,922 A 4/1994 Lo
5,310,185 A 5/1994 Viollaz et al.
5,316,298 A 5/1994 Hutin et al.
5,328,176 A 7/1994 Lo
5,346,216 A 9/1994 Aizawa
5,358,249 A 10/1994 Mendralla
5,362,055 A 11/1994 Rennie
5,398,929 A * 3/1995 Kitaichi ..... A63B 60/00 473/329
5,403,007 A 4/1995 Chen
5,405,136 A 4/1995 Hardman
5,405,137 A 4/1995 Vincent
5,425,538 A 6/1995 Vincent et al.
5,431,396 A 7/1995 Shieh
5,433,440 A 7/1995 Lin
5,447,311 A 9/1995 Viollaz et al.
5,489,094 A 2/1996 Pritchett
5,524,331 A 6/1996 Pond
5,533,681 A 7/1996 Riley et al.
5,586,947 A * 12/1996 Hutin ..... A63B 53/04 473/332
5,720,673 A 2/1998 Anderson
5,743,813 A 4/1998 Chen et al.
5,766,093 A 6/1998 Rohrer
5,766,094 A 6/1998 Mahaffey et al.
5,772,527 A 6/1998 Liu
5,827,131 A 10/1998 Mahaffey et al.
5,863,261 A 1/1999 Eggiman
5,967,903 A 10/1999 Cheng
6,074,309 A 6/2000 Mahaffey
6,165,081 A 12/2000 Chou
6,238,300 B1 5/2001 Igarashi
6,238,302 B1 5/2001 Helmstetter et al.
6,248,025 B1 6/2001 Murphy
6,302,807 B1 10/2001 Rohrer
6,354,962 B1 3/2002 Galloway
6,364,789 B1 4/2002 Kosmatka
6,390,932 B1 5/2002 Kosmatka
6,406,382 B1 6/2002 Deshmukh et al.
6,428,427 B1 8/2002 Kosmatka
6,440,008 B2 8/2002 Murphy et al.
6,443,857 B1 9/2002 Chuang
6,527,650 B2 4/2003 Reyes et al.
6,605,007 B1 8/2003 Bissonnette et al.
6,612,938 B2 9/2003 Murphy et al.
6,617,013 B2 9/2003 Morrison et al.
6,623,543 B1 9/2003 Zeller et al.
6,638,179 B2 10/2003 Yoshida
6,638,180 B2 10/2003 Tsurumaki
6,648,774 B1 11/2003 Lee
6,672,975 B1 1/2004 Galloway
6,743,117 B2 6/2004 Gilbert
6,780,124 B2 8/2004 Lu
6,837,094 B2 1/2005 Pringle et al.
6,945,876 B2 9/2005 Nakahara et al.
6,949,032 B2 9/2005 Kosmatka
6,971,960 B2 12/2005 Dewanjee et al.
6,986,715 B2 1/2006 Mahaffey
7,029,403 B2 4/2006 Rice et al.
7,086,963 B1 8/2006 Onuki et al.
7,101,290 B2 9/2006 Tucker, Sr.
7,108,612 B2 9/2006 Nakahara et al.
7,121,958 B2 10/2006 Cheng et al.
7,140,974 B2 11/2006 Chao et al.
7,160,204 B2 1/2007 Huang
7,175,540 B2 2/2007 Sano
7,182,698 B2 2/2007 Tseng
7,192,365 B2 3/2007 Souza
7,214,143 B2 5/2007 Deshmukh
7,214,144 B2 5/2007 Tseng
7,267,620 B2 9/2007 Chao et al.
7,273,420 B2 9/2007 Wright
7,281,990 B2 * 10/2007 Hagood ..... A63B 53/04 473/332
7,281,991 B2 10/2007 Gilbert et al.
7,281,994 B2 10/2007 De Shiell et al.
7,331,877 B2 2/2008 Yamaguchi et al.
7,367,898 B2 * 5/2008 Hawkins ..... A41D 13/015 473/332
7,384,348 B2 6/2008 Lin
7,399,238 B2 7/2008 Hocknell et al.
7,410,428 B1 8/2008 Dawson
7,473,186 B2 * 1/2009 Best ..... A63B 53/0487 473/340
7,591,736 B2 9/2009 Ban
7,601,078 B2 10/2009 Mergy et al.
7,628,712 B2 12/2009 Chao et al.
7,775,903 B2 8/2010 Kawaguchi
7,811,179 B2 10/2010 Roach et al.
7,850,545 B2 12/2010 Wada et al.
7,850,546 B2 12/2010 Chao et al.
7,862,452 B2 1/2011 Chao et al.
7,867,612 B2 1/2011 Schwung et al.
7,871,340 B2 1/2011 Chao
7,874,938 B2 1/2011 Chao
7,927,229 B2 4/2011 Jertson et al.
7,985,146 B2 7/2011 Lin et al.
8,152,652 B2 4/2012 Curtis et al.
8,163,119 B2 4/2012 Chao
8,221,261 B2 7/2012 Curtis et al.
8,247,062 B2 8/2012 Morrison et al.
8,293,356 B2 10/2012 Merrill et al.
8,303,432 B2 11/2012 Curtis et al.
8,376,873 B2 2/2013 Golden et al.
8,376,879 B2 2/2013 Wada et al.
8,409,032 B2 4/2013 Myrhum et al.
8,430,986 B1 4/2013 Galloway
8,444,504 B2 5/2013 Chao et al.
8,449,406 B1 5/2013 Frame
8,496,542 B2 7/2013 Curtis et al.
8,517,859 B2 8/2013 Golden et al.
8,758,161 B2 6/2014 Golden et al.
8,777,776 B2 7/2014 Wahl et al.
8,876,629 B2 11/2014 Deshmukh et al.
9,022,880 B2 5/2015 Kawaguchi
9,033,817 B2 5/2015 Snyder
9,033,818 B2 5/2015 Myrhum
9,033,822 B1 5/2015 DeMille
9,089,747 B2 * 7/2015 Boyd ..... A63B 60/54
9,192,826 B2 11/2015 Golden et al.
9,283,447 B1 3/2016 DeMille
9,539,478 B2 * 1/2017 Narita ..... A63B 53/047
9,717,960 B2 8/2017 Deshmukh
9,844,230 B2 12/2017 Bhattacharyya
10,357,901 B2 7/2019 Deshmukh
10,391,370 B2 8/2019 Tassistro
10,960,272 B2 3/2021 Kawaguchi
11,491,377 B1 * 11/2022 Sanchez ..... A63B 53/0429
11,850,461 B2 * 12/2023 Carr ..... A63B 53/0425
2001/0051549 A1 12/2001 Inoue et al.
2002/0019265 A1 2/2002 Allen
2002/0113338 A1 8/2002 Murphy
2002/0165040 A1 11/2002 Kosmatka et al.
2002/0187852 A1 12/2002 Kosmatka et al.
2003/0157995 A1 8/2003 Mahaffey
2003/0183328 A1 10/2003 Lee
2004/0266550 A1 12/2004 Gilbert et al.
2005/0003903 A1 1/2005 Galloway
2005/0020378 A1 1/2005 Krumme
2005/0043117 A1 2/2005 Gilbert
2005/0064956 A1 3/2005 Lee
2005/0101406 A1 5/2005 Hirano
2005/0124437 A1 6/2005 Imamoto
2005/0209024 A1 9/2005 Oyama
2005/0215352 A1 9/2005 Oyama
2005/0239576 A1 10/2005 Stites
2006/0052185 A1 3/2006 Kawaguchi
2006/0220279 A1 10/2006 Reyes
2006/0229141 A1 10/2006 Galloway

(56) References Cited

U.S. PATENT DOCUMENTS

| | | | |
|---|---|---|---|
| 2007/0060414 | A1 | 3/2007 | Breier |
| 2007/0099722 | A1 | 5/2007 | Stevens |
| 2008/0004131 | A1 | 1/2008 | Lin et al. |
| 2008/0051219 | A1 | 2/2008 | Erickson |
| 2008/0076595 | A1 | 3/2008 | Lai et al. |
| 2008/0096687 | A1 | 4/2008 | Chen |
| 2008/0149267 | A1 | 6/2008 | Chao |
| 2008/0268980 | A1 | 10/2008 | Breier |
| 2008/0289747 | A1 | 11/2008 | Modin |
| 2008/0293511 | A1 | 11/2008 | Gilbert et al. |
| 2008/0300068 | A1 | 12/2008 | Chao |
| 2009/0163293 | A1 | 6/2009 | Gibb |
| 2010/0125000 | A1 | 5/2010 | Lee |
| 2011/0065528 | A1 | 3/2011 | Dawson |
| 2011/0256954 | A1 | 10/2011 | Soracco |
| 2012/0135822 | A1 | 5/2012 | Deshmukh et al. |
| 2012/0172143 | A1 | 7/2012 | Greaney |
| 2012/0289363 | A1 | 11/2012 | Myrhum et al. |
| 2013/0040754 | A1 | 2/2013 | Morin |
| 2013/0040756 | A1 | 2/2013 | Myrhum |
| 2013/0040757 | A1 | 2/2013 | Deshmukh |
| 2013/0252757 | A1 | 9/2013 | Deshmukh et al. |
| 2013/0324301 | A1 | 12/2013 | Boyd |
| 2014/0038749 | A1 | 2/2014 | Beach |
| 2014/0256467 | A1 | 9/2014 | Lorentzen |
| 2014/0274454 | A1 | 9/2014 | Snyder |
| 2014/0274456 | A1 | 9/2014 | Cardani |
| 2014/0323237 | A1 | 10/2014 | Beno |
| 2015/0045146 | A1 | 2/2015 | Deshmukh et al. |
| 2015/0065267 | A1 | 3/2015 | Wahl |
| 2015/0072799 | A1* | 3/2015 | Franklin ..... A63B 60/00 473/329 |
| 2015/0108681 | A1 | 4/2015 | Deshmukh |
| 2015/0111664 | A1 | 4/2015 | Myrhum |
| 2016/0144246 | A1 | 5/2016 | Onuki |
| 2018/0008870 | A1 | 1/2018 | Cornelius |
| 2019/0126108 | A1 | 5/2019 | Parsons et al. |
| 2019/0224533 | A1 | 7/2019 | Spackman |
| 2020/0023244 | A1 | 1/2020 | Parsons |
| 2020/0061422 | A1 | 2/2020 | Chuang |
| 2020/0230471 | A1 | 7/2020 | Parsons |

OTHER PUBLICATIONS

Machine Translation of JPH05-7261.

* cited by examiner

GOLF CLUB HEAD HAVING MULTI-LAYERED STRIKING FACE

CROSS-REFERENCE TO RELATED APPLICATIONS

The present application is a continuation (CON) of co-pending U.S. patent application Ser. No. 17/563,521, filed on Dec. 28, 2021.

FIELD OF THE INVENTION

The present invention relates generally to a golf club head having a multi-layered striking face. More specifically, the striking face of the golf club head in accordance with the present invention is further comprised of an external frontal face layer, an internal rear face layer, and an intermediary sandwiched face layer juxtaposed between the external frontal face layer and the internal rear face layer.

BACKGROUND OF THE INVENTION

Modern day golf club design has evolved since the early days of golf. The good news of all the technological advancements in golf club technology is that it makes the game of golf easier for golfers of all skill levels. However, all these advancements come with tremendous challenges for the golf club engineer.

One of the latest trends in golf club design is the utilization of multiple different materials in the same golf club head to take advantage of the individual performance characteristics the base material, and combining them to create a better performing golf club head. U.S. Pat. No. 6,406,382 to Deshmukh et al. shows an example of utilizing multiple different materials in a golf club head. More specifically, U.S. Pat. No. 6,406,382 to Deshmukh et al. contemplates using high density components such as tungsten, copper, and/or chromium in a golf club head to help improve the weighting of a golf club head.

U.S. Pat. No. 9,844,230 to Snyder shows an iron body and a ball striking plate engaged with the iron body. The ball striking plate may include a face layer and a backing layer of a polymeric material to isolate the face layer from the iron body.

It should be noted that although the utilization of multi-material golf club head has been around, the industry has always been perplexed by the utilization of multi-material around the striking face portion of the golf clubhead due to the high amount of stress when impacting a golf ball. The present invention focuses on a golf club head having a multi-layered, multi-material striking face of a golf club head to further improve the performance of a golf club head.

BRIEF SUMMARY OF THE INVENTION

One aspect of the present invention is a golf club head comprising of a striking face portion located at a frontal portion of the golf club head. More particularly, the present invention contemplates a hollow iron construction with a multi-layer striking face. The striking face portion comprises an external frontal face layer located at an external frontal portion of the striking face portion, an internal rear face layer located at an internal rear portion of the striking face portion, and an intermediary sandwiched face layer, juxtaposed between the external frontal face layer and the internal rear face layer; wherein the internal rear face layer comprises a polymeric material having a flexural modulus within the range of about 30 ksi and 75 ksi, and more preferably, 50 ksi and 75 ksi. Moreover, the polymeric material preferably has a tensile strength to yield within the range of about 1.5 ksi and 8.5 ksi, and more preferably, 2 ksi and 8 ksi. Preferably, the intermediary sandwiched face layer and the external frontal face layer are completely unconstrained around their perimeters. Moreover, the external frontal face layer has an outer surface with an external frontal face layer area that is less than an area of the intermediary sandwiched face layer outer surface, which is less than an area of the internal rear face layer.

In another aspect of the present invention is a golf club head comprising of a striking face portion located at a frontal portion of the golf club head and an aft rear portion attached to the rear of the striking face portion forming a hollow iron type construction. The striking face portion further comprises of an external frontal face layer located at an external frontal portion of the striking face portion, an internal rear face layer located at an internal rear portion of the striking face portion, and an intermediary sandwiched face layer, juxtaposed between the external frontal face layer and the internal rear face layer; wherein the intermediary sandwiched face layer comprises a polymeric material having a Shore D button hardness of between about 55 to 75, wherein the intermediary sandwiched face layer has a uniform thickness, and wherein the internal rear face layer has thicker section juxtaposed the sole and extending approximately 5% to 20% up the face from the sole toward the topline. The external frontal face layer can have a uniform thickness or have a variable thickness wherein the thickness juxtaposed the sole is less than the remainder of the external frontal face layer. In either embodiment, the frontal, outer surface of the external frontal face layer is substantially planar.

Another aspect of the present invention is a golf club head comprising a striking face portion located at a frontal portion of the golf club head and an aft rear portion attached to the rear of the striking face portion forming a hollow iron type construction. The striking face portion further comprises of an external frontal face layer located at an external frontal portion of the striking face portion, an internal rear face layer located at an internal rear portion of the striking face portion, and an intermediary sandwiched face layer, juxtaposed between the external frontal face layer and the internal rear face layer. Preferably, the internal rear face layer is a face insert that is welded to the aft rear portion adjacent the topline and along the sole, between 20% and 70% of the distance from the leading edge to the back edge. The internal rear face layer has thicker section juxtaposed the sole and extending approximately 5% to 20% up the face toward the topline and approximately 5% to 60% along the sole from the leading edge toward the back edge. The external frontal face layer can have a uniform thickness or have a variable thickness wherein the thickness juxtaposed the sole is less than the remainder of the external frontal face layer. In either embodiment, the frontal, outer surface of the external frontal face layer is substantially planar.

In another aspect of the present invention, a golf club head comprises a striking face portion located at a frontal portion of a hollow iron type golf club head that comprises of an external frontal face layer located at an external frontal portion of the striking face portion, an internal rear face layer located at an internal rear portion of the striking face portion, and an intermediary sandwiched face layer, juxtaposed between the external frontal face layer and the internal rear face layer; wherein the internal rear face layer further comprises a face center region that has a thickness of between about 0.5 mm to about 1.2 mm. The external frontal face layer has a face center region that has a thickness greater than the thickness of the internal rear face center region and is between about 0.8 mm to about 1.4 mm. Still further, the intermediary sandwiched face layer is made out of a polymeric material having a Shore D button hardness of between about 55 to 75 and has a face center region with a thickness of between 0.8 mm and 1.4 mm.

In another aspect of the present invention, a golf club head comprises a striking face portion located at a frontal portion of a hollow iron type golf club head that comprises of an external frontal face layer located at an external frontal portion of the striking face portion, an internal rear face layer located at an internal rear portion of the striking face portion, and an intermediary sandwiched face layer, juxtaposed between the external frontal face layer and the internal rear face layer; wherein the internal rear face layer further comprises a face center region that has a thickness of between about 0.5 mm to about 1.2 mm and a leading edge region having a thickness of between about 1.0 mm and 1.5 mm. The external frontal face layer has a face center region that has a thickness greater than the thickness of the internal rear face center region and is between about 0.8 mm to about 1.4 mm and a leading edge region thickness of between about 0.6 mm and 1.0 mm. Preferably, the leading edge of the internal rear face layer has a thickness is approximately 20% to 50% thicker than the internal rear face layer thickness at the face center. Still further, the intermediary sandwiched face layer is formed from a thermoplastic polymeric material having a Shore D button hardness of between about 55 to 75 and has a face center region with a uniform thickness of between 0.8 mm and 1.4 mm.

In another aspect of the present invention, a golf club head comprises a striking face portion located at a frontal portion of a hollow iron type golf club head that comprises an external frontal face layer located at an external frontal portion of the striking face portion, an internal rear face layer located at an internal rear portion of the striking face portion, and an intermediary sandwiched face layer, juxtaposed between the external frontal face layer and the internal rear face layer; wherein the internal rear face layer has an outer surface that is planar and has a first frontal surface area. The intermediary sandwiched face layer is formed from a thermoplastic polymeric material having a Shore D button hardness of between about 55 to 75 and has an outer surface with a second frontal surface area that is between 90% and 99% of the first frontal surface area. Moreover, the external frontal face layer is completely separated from the internal rear face layer by the intermediary sandwiched face layer and has a planar outer surface having a third frontal surface area that is between 90% and 99% of the second frontal surface area.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken as limiting the invention, but is provided for the purpose of illustrating the general principles of the invention. The scope of the invention is best defined by the appended claims.

Various inventive features are described below and each can be used independently of one another or in combination with other features.

Figure 1:
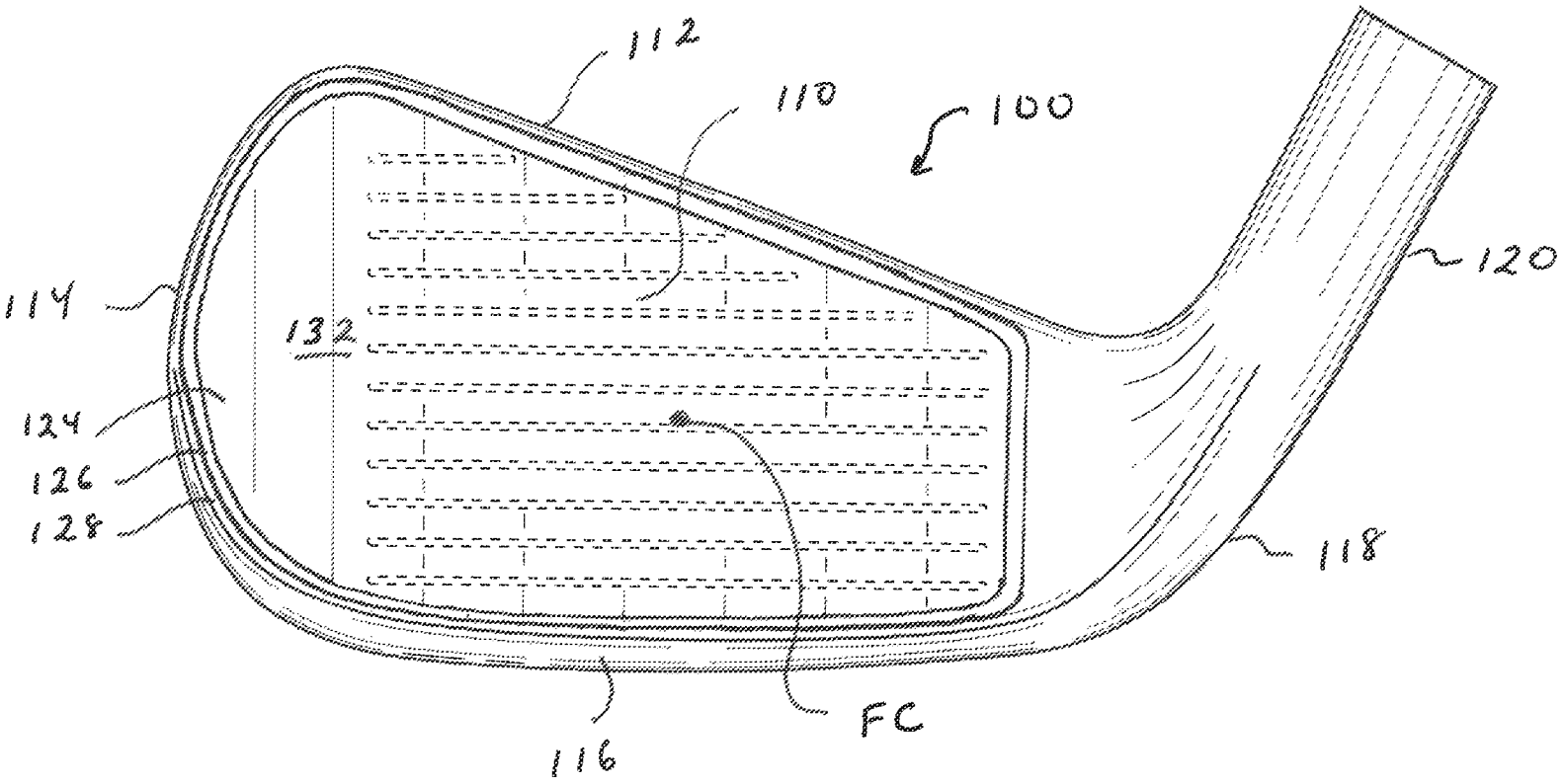
FIG. 1 of the accompanying drawings shows a frontal view of a golf club head in accordance with an embodiment of the present invention.
Figure 2:
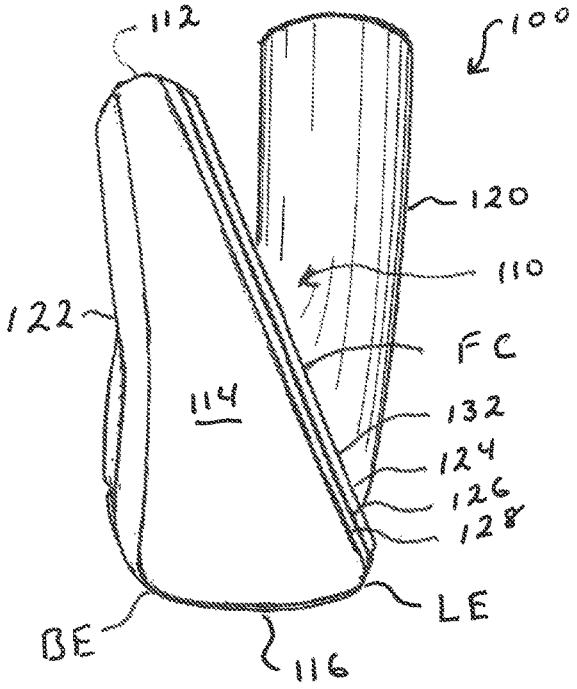
FIG. 2 of the accompanying drawings shows a toe view of a golf club head in accordance with an embodiment of the present invention.
Figure 3:
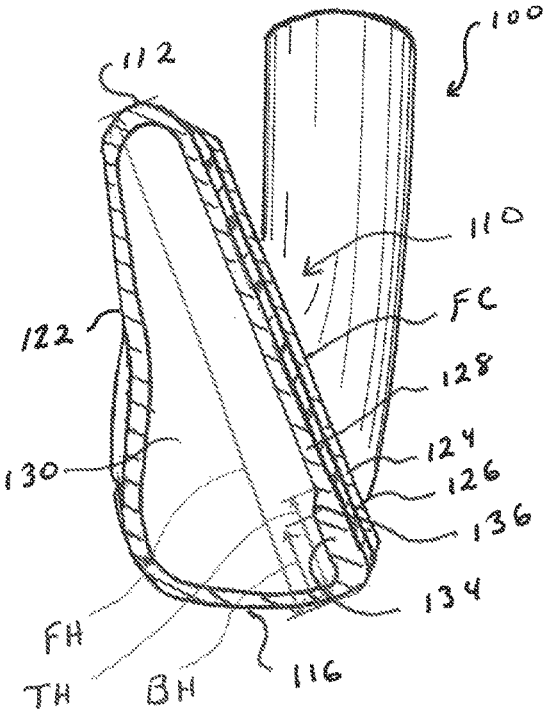
FIG. 3 of the accompanying drawings shows a cross-sectional view of the golf club head in FIG. 2.

FIG. 1 of the accompanying drawings shows a golf club head 100 in accordance with an exemplary embodiment of the present invention. Golf club head 100 shown here may have striking face portion 110, an aft rear portion (not shown), a topline 112, a toe portion 114, a sole 116, a heel portion 118 and hosel 120. The striking face portion 110 includes a face center FC. FIG. 2 is a toe view of the golf club head in FIG. 1 and shows the striking face portion 110 and the aft rear portion 122. Furthermore, FIG. 2 illustrates the leading edge LE and the back edge BE. FIG. 3 shows a cross-sectional view of the golf club head 100 in FIGS. 1 and 2. The striking face portion 110 further comprises an external frontal face layer 124, an intermediary sandwiched face layer 126, and an internal rear face layer 128. This triple layered face improves the performance of the golf club head 100 by reducing unnecessary mass from the striking face portion 110 and as discussed below improve the interaction with a golf ball by producing more ball speed across the face. The present invention is particularly directed to the golf club head 100 comprising of a striking face portion 110 and the aft rear portion that form a hollow iron construction with an internal cavity 130 formed therein and having a multi-layer striking face portion 110.

The striking face portion 110 comprises the external frontal face layer 124 preferably formed of steel and located at an external frontal portion of the striking face portion 110. The external frontal face layer 124 has a substantially planar striking outer surface 132. More preferably, the external frontal face layer 124 is formed of a high strength steel having an Ultimate Tensile Strength of greater than 2000 MPa and more preferably greater than 2300 MPa. Most preferably, the external frontal face layer 124 is formed from AerMet 340 or the like. Moreover, it is preferred that the external frontal face layer 124 has a uniform thickness of about 0.8 mm to about 1.4 mm. Most preferably, the external frontal face layer 124 has a uniform thickness of about 0.9 mm to about 1.1 mm. This thin external frontal face layer 124 and its high strength assist in creating the high COR of the golf club head 100.

The internal rear face layer 128 is located at the internal rear portion of the striking face portion 110. The internal rear face layer 128 can be cast as a portion of the golf club head 100 or formed of sheet metal, stamped or forged to shape and welded to the golf club head body. Preferably, the internal rear face layer 128 has a thickness at face center that is between about 0.5 mm and 1.2 mm, and more preferably, between about 0.7 mm and 0.9 mm. This thin layer assist in creating the high COR of the golf club head 100. In order to reduce stresses, the internal rear face layer bottom portion 134 is thicker that the internal rear face layer at face center FC. More preferably, when measured in the vertical plane containing the face center and perpendicular to the planar striking outer surface 132, the internal rear face layer bottom portion 134 has a thickness of about 1.1 mm to 1.4 mm, and most preferably between about 1.15 mm and 1.3 mm, that is between about 20% and 50% greater than the internal rear face layer thickness at the face center FC. The height of the internal rear face layer bottom portion 134 BH is preferably between about 5 mm and 10 mm and is between about 10% and 15% of the face height FH, which is measured from the sole 116 to the topline 112 at face center. The internal rear face layer 128 also includes a transition portion 136 that extends between the thicker internal rear face layer bottom portion 134 and the remainder of the internal rear face layer 128. The transition portion 136 preferably has a transition height TH measured from the sole 116 toward the topline 112 of about 10 mm to 15 mm and between about 20% to 25% of the face height FH. In the most preferred embodiment, the transition height TH is approximately 70% to 100% larger than the internal rear face layer bottom portion height BH.

The striking face portion 110 is further comprised of the intermediary sandwiched face layer 126, which is juxtaposed between the external frontal face layer 124 and the internal rear face layer 128. Preferably, the intermediary sandwiched face layer 126 is completely unconstrained around its perimeter, i.e., the intermediary sandwiched face layer 126 does not sit in a cavity or is otherwise constrained on its perimeter. This helps improve the overall striking face COR. Moreover, it is preferred that the intermediary sandwiched face layer 126 has an outer surface with a frontal surface area that is less than a frontal area of the internal rear face layer. Preferably, the intermediary sandwiched face layer 126 frontal surface area is between about 90% to 99% of the frontal area of the internal rear face layer outer surface as shown best in FIG. 1. Still further, the external frontal face layer 124 has a frontal surface area that is between about 90% to 99% of the frontal surface area of the intermediary sandwiched face layer 126.

The intermediary sandwiched face layer 126 is a polymeric material having a flexural modulus within the range of about 30 ksi and 75 ksi, and more preferably, 50 ksi and 75 ksi, when measured according to ASTM D790. The high flexural modulus assists in creating a striking face portion with a very high COR. Moreover, the polymeric material preferably has a tensile strength to yield within the range of about 1.5 ksi and 8.5 ksi, and more preferably, 2 ksi and 8 ksi when measured according to ASTM D412, test method A. Still further, to keep the striking face portion from being too heavy, the specific gravity of the polymer is preferably between about 0.95 and 1.2. Preferably, the intermediary sandwiched face layer 126 is comprised of an ionomeric material, and more preferably, a blend of a sodium catalyzed ionomer with a lithium or zinc catalyzed ionomer such as those sold by Dow under the Surlyn™ brand. In another embodiment, the intermediary sandwiched face layer 126 is comprised of a thermoplastic urethane material such as Estane ETEs sold by Lubrizol. Preferably, the polymeric material also has a Shore D hardness of 55 to 75 when measured on a button according to ASTM 2240. More preferably, the polymeric material has a Shore D hardness of 60 to 70 when measured on a button. Moreover, the intermediary sandwiched face layer 126 is preferably comprised of a polymeric material having a Bayshore resilience of at least 70%, and more preferably, at least about 80% when measured according to ASTM 2632. Furthermore, the intermediary sandwiched face layer 126 preferably has a uniform face thickness of about 0.8 mm to 1.2 mm, and more preferably, between about 0.9 mm and 1.1 mm. The intermediary sandwiched face layer 126 is also preferably at least 10% thicker than the internal rear face layer thickness at the face center FC.

Figure 4:
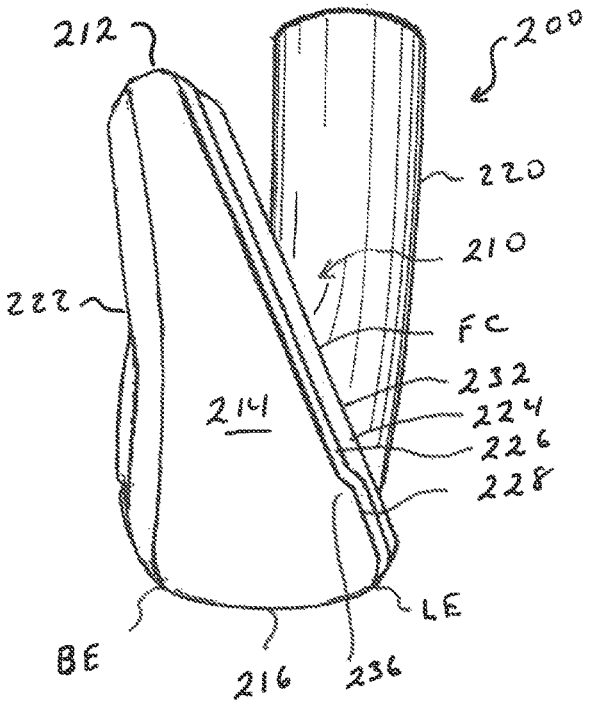
FIG. 4 of the accompanying drawings shows a toe view of a golf club head in accordance with an embodiment of the present invention.
Figure 5:
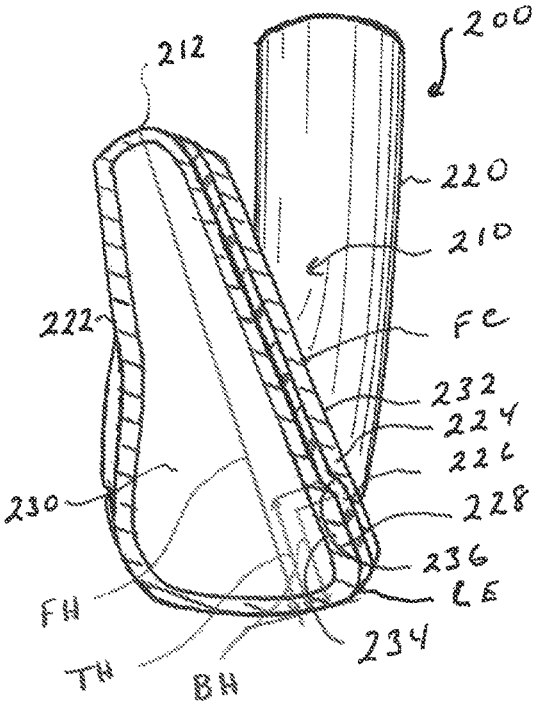
FIG. 5 of the accompanying drawings shows a cross-sectional view the golf club head in FIG. 4.

Referring now to FIGS. 4 and 5, the golf club head 200 of this embodiment of the invention has a frontal view that looks identical to the frontal view of the golf club head 100 as shown in FIG. 1. The striking face portion 210 includes a face center FC. FIG. 4 is a toe view and shows the striking face portion 210, the aft rear portion 222, the topline 212, the sole 216, the toe portion 214, and the hosel 220. Furthermore, FIG. 4 illustrates the leading edge LE and the back edge BE. FIG. 5 shows a cross-sectional view of the golf club head 200 in FIG. 4. The striking face portion 210 comprises an external frontal face layer 224, an intermediary sandwiched face layer 226, and an internal rear face layer 228. This triple layered face improves the performance of the golf club head 200 by reducing unnecessary mass from the striking face portion 210 and as discussed below improve the interaction with a golf ball by producing more ball speed across the face. The present invention is particularly directed to the golf club head 200 comprising of a striking face portion 210 and the aft rear portion that form a hollow iron construction with an internal cavity 230 formed therein and having a multi-layer striking face portion 210.

The striking face portion 210 comprises the external frontal face layer 224 preferably formed of steel and located at an external frontal portion of the striking face portion 210. The external frontal face layer 224 has a substantially planar striking outer surface 232. More preferably, the external frontal face layer 224 is formed of a high strength steel having an Ultimate Tensile Strength of greater than 2000 MPa and more preferably greater than 2300 MPa. Most preferably, the external frontal face layer 224 is formed from AerMet 340 or the like. Moreover, it is preferred that the external frontal face layer 224 has a first external frontal face layer thickness at the face center FC of about 0.8 mm to about 1.4 mm. Most preferably, the first external frontal face layer thickness is about 0.9 mm to about 1.1 mm. This thin external frontal face layer 224 and its high strength assist in creating the high COR of the golf club head 200. The external frontal face layer 224 has a second external frontal face layer thickness in a lower section extending up from the leading edge LE of about 0.4 mm to about 1.0 mm. Most preferably, the second external frontal face layer thickness is about 0.5 mm to about 0.7 mm.

The internal rear face layer 228 is located at the internal rear portion of the striking face portion 210. The internal rear face layer 228 can be cast as a portion of the golf club head 200 or formed of sheet metal, stamped or forged to shape and welded to the golf club head body. Preferably, the internal rear face layer 228 has a thickness at face center that is between about 0.5 mm and 1.2 mm, and more preferably, between about 0.7 mm and 0.9 mm. This thin layer assist in creating the high COR of the golf club head 200. In order to reduce stresses, the internal rear face layer bottom portion 234 is thicker than the internal rear face layer at face center FC. More preferably, when measured in the vertical plane containing the face center and perpendicular to the planar striking outer surface 232, the internal rear face layer bottom portion 234 has a thickness of about 1.1 mm to 1.4 mm, and most preferably between about 1.15 mm and 1.3 mm, that is between about 20% and 50% greater than the internal rear face layer thickness at the face center FC. In this embodiment, the internal rear face layer bottom portion 234 has the increased thickness on the outer surface as opposed to the inner surface on internal rear face layer 128 discussed above. Thus, this embodiment has the thinner section on the bottom portion of the external frontal face layer 224 as discussed above. The height of the internal rear face layer bottom portion 234 BH is preferably between about 5 mm and 10 mm and is between about 10% and 15% of the face height FH, which is measured from the sole 216 to the topline 212 at face center. The internal rear face layer 228 also includes a transition portion 236 that extends between the thicker internal rear face layer bottom portion 234 and the remainder of the internal rear face layer 228. The transition portion 236 preferably has a transition height TH measured from the sole 216 toward the topline 212 of about 10 mm to 15 mm and between about 20% to 25% of the face height FH. In the most preferred embodiment, the transition height TH is approximately 70% to 100% larger than the internal rear face layer bottom portion height BH.

The striking face portion 210 is further comprised of the intermediary sandwiched face layer 226, which is juxtaposed between the external frontal face layer 224 and the internal rear face layer 228. Preferably, the intermediary sandwiched face layer 226 is completely unconstrained around its perimeter, i.e., the intermediary sandwiched face layer 226 does not sit in a cavity or is otherwise constrained on its perimeter. This helps improve the overall striking face COR. Moreover, it is preferred that the intermediary sandwiched face layer 226 has an outer surface with a frontal surface area that is less than a frontal area of the internal rear face layer. Preferably, the intermediary sandwiched face layer 226 frontal surface area is between about 90% to 99% of the frontal area of the internal rear face layer as shown best in FIG. 1. Still further, the external frontal face layer 224 has a frontal area that is between about 90% to 99% of the frontal area of the intermediary sandwiched face layer 226.

The intermediary sandwiched face layer 226 is a polymeric material having a flexural modulus within the range of about 30 ksi and 75 ksi, and more preferably, 50 ksi and 75 ksi, when measured according to ASTM D790. The high flexural modulus assists in creating a striking face portion with a very high COR. Moreover, the polymeric material preferably has a tensile strength to yield within the range of about 1.5 ksi and 8.5 ksi, and more preferably, 2 ksi and 8 ksi when measured according to ASTM D412, test method A. Still further, to keep the striking face portion from being too heavy, the specific gravity of the polymer is preferably between about 0.95 and 1.2. Preferably, the intermediary sandwiched face layer 226 is comprised of an ionomeric material, and more preferably, a blend of a sodium catalyzed ionomer with a lithium or zinc catalyzed ionomer such as those sold by Dow under the Surlyn™ brand. In another embodiment, the intermediary sandwiched face layer 226 is comprised of a thermoplastic urethane material such as Estane ETEs sold by Lubrizol. Preferably, the polymeric material also has a Shore D hardness of 55 to 75 when measured on a button according to ASTM 2240. More preferably, the polymeric material has a Shore D hardness of 60 to 70 when measured on a button. Moreover, the intermediary sandwiched face layer 226 is preferably comprised of a polymeric material having a Bayshore resilience of at least 70%, and more preferably, at least about 80% when measured according to ASTM 2632. Furthermore, the intermediary sandwiched face layer 226 preferably has a uniform face thickness of about 0.8 mm to 1.2 mm, and more preferably, between about 0.9 mm and 1.1 mm. The intermediary sandwiched face layer 226 is also preferably at least 10% thicker than the internal rear face layer thickness at the face center FC.

Figure 6:
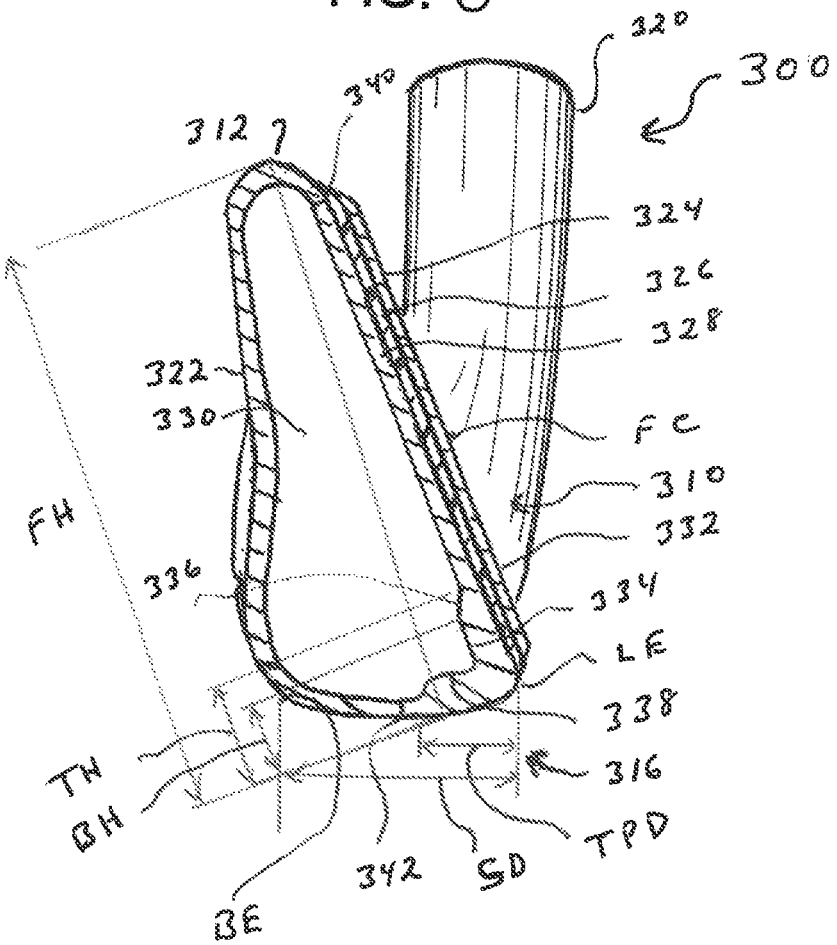
FIG. 6 of the accompanying drawings shows a cross-sectional view the golf club head in accordance with an embodiment of the present invention.

Referring now to FIG. 6, the golf club head 300 of this embodiment of the invention looks identical to the golf club head 100 as shown in FIG. 1 and the golf club head 200 as shown in FIG. 2. The striking face portion 310 includes a face center FC. FIG. 6 is a cross-sectional view and shows the striking face portion 310, the aft rear portion 322, the topline 312, the sole 316, and the hosel 320. Furthermore, FIG. 6 illustrates the leading edge LE and the back edge BE. The striking face portion 310 comprises an external frontal face layer 324, an intermediary sandwiched face layer 326, and an internal rear face layer 328. This triple layered face improves the performance of the golf club head 300 by reducing unnecessary mass from the striking face portion 310 and as discussed below improve the interaction with a golf ball by producing more ball speed across the face. The present invention is particularly directed to the golf club head 300 comprising of a striking face portion 310 and the aft rear portion 322 that form a hollow iron construction with an internal cavity 330 formed therein and having a multilayer striking face portion 310.

The striking face portion 310 comprises the external frontal face layer 324 preferably formed of steel and located at an external frontal portion of the striking face portion 310. The external frontal face layer 324 has a substantially planar striking outer surface 332. More preferably, the external frontal face layer 324 is formed of a high strength steel having an Ultimate Tensile Strength of greater than 2000 MPa and more preferably greater than 2300 MPa. Most preferably, the external frontal face layer 324 is formed from AerMet 340 or the like. Moreover, it is preferred that the external frontal face layer 324 has a uniform external frontal face layer thickness of about 0.8 mm to about 1.4 mm. Most preferably, the external frontal face layer thickness is about 0.9 mm to about 1.1 mm. This thin external frontal face layer 324 and its high strength assist in creating the high COR of the golf club head 300.

The internal rear face layer 328 is located at the internal rear portion of the striking face portion 310. The internal rear face layer 328 in this embodiment formed of sheet metal, stamped to an L-shape and welded to the golf club head 300 around the perimeter of the internal rear face layer 328 as shown at weld lines 340 along the topline 312, weld line 342 across the sole 316 and welds down the toe portion and heel portion (not shown). Preferably, the internal rear face layer 328 is a face insert that is welded to the aft rear portion adjacent the topline 312 and along the sole 316, between 20% and 70% of the distance from the leading edge LE to the back edge BE. Preferably, the internal rear face layer 228 has a thickness at face center that is between about 0.5 mm and 1.2 mm, and more preferably, between about 0.7 mm and 0.9 mm. This thin layer assist in creating the high COR of the golf club head 300. In order to reduce stresses, the internal rear face layer bottom portion 334 is thicker than the internal rear face layer at face center FC. More preferably, when measured in the vertical plane containing the face center and perpendicular to the planar striking outer surface 332, the internal rear face layer bottom portion 334 has a thickness of about 1.1 mm to 1.4 mm, and most preferably between about 1.15 mm and 1.3 mm. Preferably, the internal rear face layer bottom portion thickness is approximately 20% to 50% thicker than the internal rear face layer thickness at the face center FC.

In this embodiment, the internal rear face layer bottom portion 334 also has the increased thickness along the sole portion of the internal rear face layer 338 extending from the leading edge LE toward the back edge BE. The height of the internal rear face layer bottom portion 334 BH is preferably between about 5 mm and 10 mm and is between about 10% and 15% of the face height FH, which is measured from the sole 316 to the topline 312 at face center. The internal rear face layer 328 also includes a transition portion 336 that extends between the thicker internal rear face layer bottom portion 334 and the remainder of the internal rear face layer 328. The transition portion 336 preferably has a transition height TH measured from the sole 316 toward the topline 312 of about 10 mm to 15 mm and between about 20% to 25% of the face height FH. In the most preferred embodiment, the transition height TH is approximately 70% to 100% larger than the internal rear face layer bottom portion height BH. Still further, it is preferred that the height of the internal rear face layer bottom portion 334 BH and the transition height TH are greatest in the plane containing the face center FC. That is, the height of the internal rear face layer bottom portion 334 BH and the transition height TH are preferably less if measured in a plane ½ inch toward the heel portion from face center FC and ½ inch toward the toe portion from face center FC of the striking face portion 310. Preferably, the height of the internal rear face layer bottom portion 334 BH and the transition height TH are arcuate across the striking face portion 310 from the toe portion to the heel portion, with the peak being approximately at the face center FC. The sole portion of the internal rear face layer 338 preferably has a thickness that is approximate the thickness of the internal rear face layer bottom portion 334, between about 1.1 mm and 1.4 mm and preferably between 1.15 mm and 1.3 mm, and extends from the leading edge LE toward the back edge BE a distance TPD that is about 5% to 60%, and more preferably, 30% to 60%, of the total sole depth SD.

The striking face portion 310 is further comprised of the intermediary sandwiched face layer 326, which is juxtaposed between the external frontal face layer 324 and the internal rear face layer 328. Preferably, the intermediary sandwiched face layer 326 is completely unconstrained around its perimeter, i.e., the intermediary sandwiched face layer 326 does not sit in a cavity or is otherwise constrained on its perimeter. This helps improve the overall striking face COR. Moreover, it is preferred that the intermediary sandwiched face layer 326 has an outer surface with a frontal surface area that is less than a frontal surface area of the internal rear face layer. Preferably, the intermediary sandwiched face layer 326 frontal surface area is between about 90% to 99% of the frontal surface area of the internal rear face layer as shown best in FIG. 1. Still further, the external frontal face layer 324 has a frontal surface area that is between about 90% to 99% of the frontal surface area of the intermediary sandwiched face layer 326.

The intermediary sandwiched face layer 326 is a polymeric material having a flexural modulus within the range of about 30 ksi and 75 ksi, and more preferably, 50 ksi and 75 ksi, when measured according to ASTM D790. The high flexural modulus assists in creating a striking face portion with a very high COR. Moreover, the polymeric material preferably has a tensile strength to yield within the range of about 1.5 ksi and 8.5 ksi, and more preferably, 2 ksi and 8 ksi when measured according to ASTM D412, test method A. Still further, to keep the striking face portion from being too heavy, the specific gravity of the polymer is preferably between about 0.95 and 1.2. Preferably, the intermediary sandwiched face layer 326 is comprised of an ionomeric material, and more preferably, a blend of a sodium catalyzed ionomer with a lithium or zinc catalyzed ionomer such as those sold by Dow under the Surlyn™ brand. In another embodiment, the intermediary sandwiched face layer 326 is comprised of a thermoplastic urethane material such as Estane ETEs sold by Lubrizol. Preferably, the polymeric material also has a Shore D hardness of 55 to 75 when measured on a button according to ASTM 2240. More preferably, the polymeric material has a Shore D hardness of 60 to 70 when measured on a button. Moreover, the intermediary sandwiched face layer 326 is preferably comprised of a polymeric material having a Bayshore resilience of at least 70%, and more preferably, at least about 80% when measured according to ASTM 2632. Furthermore, the intermediary sandwiched face layer 326 preferably has a uniform face thickness of about 0.8 mm to 1.2 mm, and more preferably, between about 0.9 mm and 1.1 mm. The intermediary sandwiched face layer 326 is also preferably at least 10% thicker than the internal rear face layer thickness at the face center FC.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron type golf club head comprising:

a striking face portion located at a frontal portion of said golf club head and an aft rear portion attached to said striking face portion forming an internal cavity therebetween;

said striking face portion having a face center and further comprises;

an external frontal face layer located at an external frontal portion of said striking face portion and having a face center thickness of between 0.8 mm and 1.4 mm at the face center and a leading edge region thickness of between about 0.6 mm and 1.0 mm;

an internal rear face layer located at an internal rear portion of said striking face portion and having an internal face center thickness of between 0.5 mm and 1.2 mm at the face center and the internal rear face layer includes an internal rear face layer bottom portion having a thickness of between 1.1 mm and 1.4 mm and that is between 20% and 50% greater than the internal face center thickness, wherein the face center thickness is greater than the internal face center thickness; and an intermediary sandwiched face layer, juxtaposed between said external frontal face layer and said internal rear face layer, having an unconstrained perimeter and having a thickness of 0.8 mm and 1.2 mm at the face center; and wherein said intermediary sandwiched face layer is comprised of a polymeric material having a flexural modulus of between 30 ksi and 75 ksi.

2. The golf club head of claim 1, wherein said intermediary sandwiched face layer completely separates said external frontal face layer from said internal rear face layer and said external frontal face layer has an unconstrained external frontal face layer perimeter.

3. The golf club head of claim 1, wherein said intermediary sandwiched face layer has a tensile strength to yield of between 1.5 ksi and 8 ksi.

4. The golf club head of claim 1, wherein said intermediary sandwiched face layer has a Shore D hardness of between about 55 to 75.

5. The golf club head of claim 1, wherein said intermediary sandwiched face layer has an intermediary sandwiched face layer frontal surface area that is between 90% and 99% of an internal rear face layer frontal surface area.

6. The golf club head of claim 5, wherein said external frontal face layer has an external frontal face frontal surface area that is between 90% and 99% of said intermediary sandwiched face layer frontal surface area.

7. A golf club head comprising:

a striking face portion located at a frontal portion of said golf club head and an aft rear portion attached to said striking face portion forming an internal cavity therebetween;

said striking face portion having a face center and further comprises;

an external frontal face layer located at an external frontal portion of said striking face portion and having a face center thickness of between 0.8 mm and 1.4 mm at the face center;

an internal rear face layer located at an internal rear portion of said striking face portion and having an internal face center thickness of between 0.7 mm and 0.9 mm at the face center and the internal rear face layer includes an internal rear face layer bottom portion having a thickness of between 1.1 mm and 1.4 mm and that is between 20% and 50% greater than the internal face center thickness, wherein the face center thickness is greater than the internal face center thickness; and an intermediary sandwiched face layer, juxtaposed between said external frontal face layer and said internal rear face layer, having an unconstrained perimeter and having a thickness of 0.8 mm and 1.2 mm at the face center; and wherein said intermediary sandwiched face layer is comprised of a polymeric material having a flexural modulus of between 30 ksi and 75 ksi.

8. The golf club head of claim 7, wherein said intermediary sandwiched face layer completely separates said external frontal face layer from said internal rear face layer and said external frontal face layer has an unconstrained external frontal face layer perimeter.

9. The golf club head of claim 8, wherein said intermediary sandwiched face layer has an intermediary sandwiched face layer frontal surface area that is between 90% and 99% of an internal rear face layer frontal surface area.

10. The golf club head of claim 9, wherein said external frontal face layer has an external frontal face frontal surface area that is between 90% and 99% of said intermediary sandwiched face layer frontal surface area.

* * * * *